US005752890A

United States Patent [19]

Shishido et al.

[11] Patent Number: 5,752,890

[45] Date of Patent: May 19, 1998

[54] BALL FOR BALL GAME AND METHOD FOR MANUFACTURING THE SAME

[75] Inventors: Hideomi Shishido; Hisashi Ikemoto, both of Hiroshima, Japan

[73] Assignee: Molten Corporation, Hiroshima-ken, Japan

[21] Appl. No.: 925,441

[22] Filed: Sep. 8, 1997

Related U.S. Application Data

[63] Continuation of Ser. No. 536,634, Sep. 29, 1995, abandoned.

[30] Foreign Application Priority Data

May 10, 1994 [JP] Japan ..... 6-268255

[51] Int. Cl.[6] ..... A63B 41/08

[52] U.S. Cl. ..... 473/599; 473/604

[58] Field of Search ..... 473/597, 598, 473/599, 600, 601, 602, 603, 604, 607, 608; 273/DIG. 20

[56] References Cited

U.S. PATENT DOCUMENTS

| | | | |
|---|---|---|---|
| 4,542,902 | 9/1985 | Massino | 273/65 A |
| 4,606,544 | 8/1986 | Olazabal, Jr. | 273/65 R |
| 4,830,373 | 5/1989 | Dehnert et al. | 273/65 ED |
| 4,856,781 | 8/1989 | Shishido et al. . | |

FOREIGN PATENT DOCUMENTS

| | | | |
|---|---|---|---|
| 0220741 | 5/1987 | European Pat. Off. . | |
| 2738319 | 8/1977 | Germany . | |
| 51-40170 | 11/1976 | Japan . | |
| 51-40171 | 11/1976 | Japan . | |
| 52-43931 | 11/1977 | Japan . | |
| 63-15353 | 4/1988 | Japan . | |
| 2136660 | 11/1990 | Japan . | |
| 6272128 | 3/1993 | Japan . | |
| 1743623 | 6/1992 | U.S.S.R. | 273/65 E |
| A2272380 | 5/1994 | United Kingdom . | |

OTHER PUBLICATIONS

Derwent Publications Ltd., London, GB; Section Ch, Week 9443, Sep. 1994.

*Primary Examiner*—Steven B. Wong

*Attorney, Agent, or Firm*—Antonelli, Terry, Stout & Kraus, LLP

[57] ABSTRACT

A ball for ball game comprising: a leather skin layer formed by sewing a plurality of leather panels by a thread, the leather skin layer having a spherical shape; and a bladder made of an elastomer having a hollow spherical shape, the bladder being accomodated in the leather skin layer, the bladder being provided with a valve for feeding air into the rubber bladder, the bladder being charged with air through the valve; wherein the thread is made of a self-shrink thread which is subjected to a shrinking treatment after sewing.

14 Claims, 6 Drawing Sheets

BALL FOR BALL GAME AND METHOD FOR MANUFACTURING THE SAME

This application is a continuation application of Ser. No. 08/536,634 filed Sep. 29, 1995, which is now abandoned.

BACKGROUND OF THE INVENTION

The present invention relates to a ball for a ball game such as a soccer ball, or more particularly to a ball of a sewn structure for a ball game, and a manufacturing method thereof.

Hitherto, in a ball for a ball game having an air sealed structure, such as a soccer ball, handball, volleyball, and playground ball, ends of a plurality of leather panels are folded inside, the folded portions are sewn by a thread to form a spherical leather skin layer on the whole, and a rubber bladder of hollow spherical shape is contained in this leather skin layer, which is known as a ball for a ball game having a sewn structure (or known as a sewn ball) (for example, Japanese Unexamined Utility Model Publication No. 136660/1990).

FIG. 1 to FIG. 3 show an example of a soccer ball having a sewn structure, in which twenty hexagonal leather panels 2, 2 . . . and twelve pentagonal leather panels 3, 3 . . . are sewn together end to end by a thread 4 to form a leather skin layer 5, and a bladder 6 of a hollow spherical elastic rubber of small air permeability such as latex and butyl rubber is contained inside. The bladder 6 is inflated with a compressed air through a valve (not shown).

As leather panels 2, 2 . . . . 3, 3 . . . . natural leather or artificial leather is used. Usually on the back side of the leather panels 2, 3, a reinforcing cloth layer 7 is formed by adhering two to four layers of cotton cloth or polyester and cotton blended cloth with latex or other adhesive, and this reinforcing cloth layer 7 is included in the leather panels 2, 3 in the explanations to follow.

On the periphery of the leather panels 2, 2 . . . . 3, 3 . . . . as shown in FIG. 3, multiple sewing holes 8, 8 . . . are provided, and a thread 4 is passed through these sewing holes 8, 8 . . . . and the two leather panels 2, 2 are sewn together. As the thread 4, polyester thread, cotton thread, hemp thread, nylon thread, or the like is used.

Also known is the high shrinkage polyester fiber which shrinks by scores of percent by heat treatment (for example, Japanese Examined Patent Publication No. 40170/1976). This publication discloses a manufacturing method of high shrinkage polyester fiber by drawing polyethylene terephthalate undrawn fiber by 2.5 to 2.9 times in a warm water bath at 60° to 70° C., cooling to 40° C. or less after drawing, feeding into a crimper to crimp, and drying at 45° C. or less after crimping, and such high shrinkage polyester fiber is claimed to shrink by 30% or more in a warm water bath at 70° C. Besides, the high shrinkage polyester shrink yarn is disclosed in Japanese Examined Patent Publications Nos. 40171/1976 and 43931/1977. On the other hand, the wet shrink polyvinyl alcohol (PVA) fiber is known to shrink by scores of percent by water absorption treatment (for example, Japanese Examined Utility Model Publication No. 15353/1988). The wet shrink PVA fiber disclosed in this publication is obtained by spinning PVA of polymerization degree of 300 to 2400 and saponification degree of 90 to 99.9 mol % in ordinary dry or wet process, drawing by 1.5 times or more in an atmosphere at 130° C. or less in moisture absorbing state, and drying, and moreover, after drying, heat treatment may be done in tense state, or in the wet process, scouring process may be done later for removing salts, according to the publication. This wet shrink PVA fiber is known to shrink by 10 to 60% within 30 seconds when immersed in water at 40° C. or less.

Such fiber shrinking by more than 10% by treatment by heating or water absorption is known as self-shrinking yarn. Generally, chemical fibers shrink by heating, but the value is very small, usually about 2 to 3%.

In the sewn structure ball, for example, a soccer ball, the ball sticks to the foot when kicking, and it is easy to exhibit advanced skills in shooting, dribbling and passing, and it excels in game performance, but it is inferior in durability. Similarly, in the handball, volleyball, and playground ball, the sewn ball excels in gripping performance (ease of catching), and is hence easy to control, the trajectory is stable when thrown, not swaying irregularly, and the pain is less if hit against part of the body, but the problem lies in the durability, too. That is, in the sewn ball, as used repeatedly, the sewn portion is expanded as shown in FIG. 4 (called seam opening 11), and the ball is swollen and deformed. For example, when a soccer ball of size No. 5 (initial circumference 685 mm) was used in soccer exercises and games for six months, the circumference was swollen to 705 mm to 710 mm. By contrast, the laminated structure ball excellent in durability (of the same size) was swollen to 700 mm.

The laminated structure ball is manufactured by winding a nylon yarn of about thousands of meters long uniformly on a rubber bladder to form a reinforcing layer to prevent the spherical form from swelling, and laminating a plurality of leather panels thereon through a thin rubber layer, and it is usually called a laminated ball. This laminated ball is extremely excellent in durability because of the reinforcing layer, but the feeling of kicking and contact is poor, and it is inferior in game performance as compared with the sewn ball, and it is exclusively used as an exercise ball or a game ball for low technical level players among school children.

SUMMARY OF THE INVENTION

It is an object of the invention to present a sewn ball enhanced in durability, without sacrificing the high game performance such as gripping and ball control.

According to a first aspect of the present invention, the invention relates to a ball for ball game comprising:

A leather skin layer formed by sewing a plurality of leather panels by a thread, said leather skin layer having a spherical shape; and a bladder made of an elastomer having a hollow spherical shape, said bladder being accomodated in said leather skin layer, said bladder being provided with a valve for feeding air into said rubber bladder, said bladder being charged with air through said valve;

wherein said thread is made of a self-shrink thread which is subjected to a shrinking treatment after sewing.

In one form of the ball for a ball game of the invention, the self-shrinking thread shrinks by heating.

In this ball for a ball game of the invention the self-shrink thread preferably comprises a high shrinkage polyester fiber.

In another form of the ball for a ball game of the invention, the self-shrink thread shrinks by absorbing water.

In this ball for ball game of the invention, the self-shrinking thread which shrinks by absorbing water preferably comprises wet shrink polyvinyl alcohol fiber.

The leather skin layer of the ball for a ball game of according to one embodiment the invention comprises a plurality of hexagonal leather panels and pentagonal leather panels, and the ball for ball game can be used as a soccer ball or a handball.

The leather skin layer of the ball for a ball game according to a second embodiment of the invention comprises a plurality of almost square leather panels, and the ball for ball game can be used as a volleyball or a playground ball.

According to second aspect of the present invention, the invention relates to a method of manufacturing a ball for a ball game of the invention a said method comprising a step of forming a hollow spherical rubber bladder, a step of sewing a plurality of leather panels into a spherical form with a self-shrink thread to form a leather skin layer, and putting the bladder into the leather skin layer, and a step of shrinking the self-shrink thread by heat.

The self-shrink thread of the present invention is subjected to shrinking treatment after sewing the leather panels to each other. The leather panels are firmly tightened to each other by the shrinked thread, such that opening of a seam in the leather skin layer and swelling of the ball are prevented from occurring.

When the self-shrink thread comprises a thread which shrinks by heating, the self-shrink thread is shrinked by heating after sewing, so that the leather panels can be firmly tightened to each other. The shrinking property of the thread can be kept even if the temperature of the heated thread is returned to ambient temperature.

When the self-shrink thread which shrinks by heating comprises a high shrinkage polyester fiber, a high shrinkage rate can be achieved with a constant rate.

When the self-shrink thread comprises a thread that shrinks upon absorbing water, the thread is shrinked by absorbing rainwater or the like in operative condition or subjected to a treatment of absorbing water forcedly, so that the leather panels are firmly tightened to each other. The shrinkage property of the thread can be kept after absorbing water even if the thread is dried.

When the self-shrink thread comprises a wet shrinkage PVA fiber, a high shrinkage rate can be achieved with a constant rate.

In accordance with the ball of the invention, the game performance such as gripping, ball control and stability of trajectory by kicking or hitting can be maintained in a high state.

DETAILED DESCRIPTION

Figure 1:
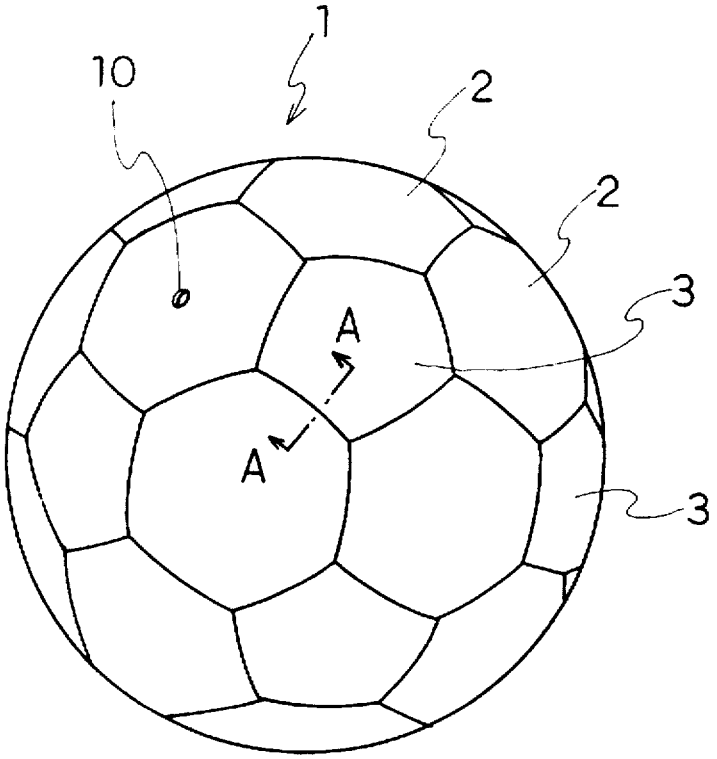
FIG. 1 is a front view of the ball for ball game illustrating a conventional ball and the present invention.
Figure 2:
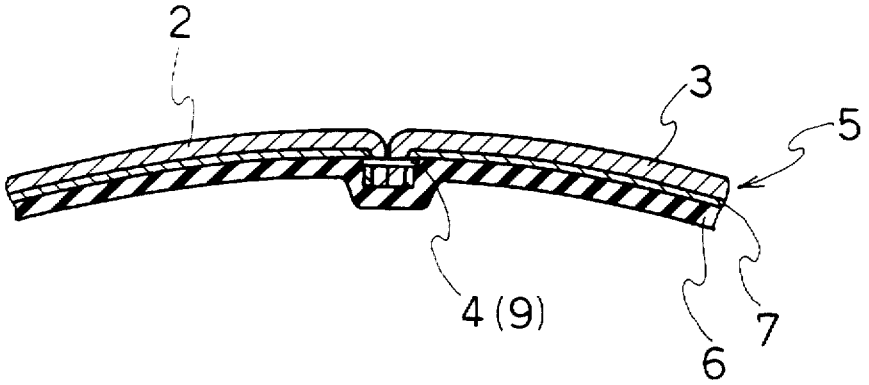
FIG. 2 is a cross sectioned view taken along lines A—A of FIG. 1.
Figure 3:
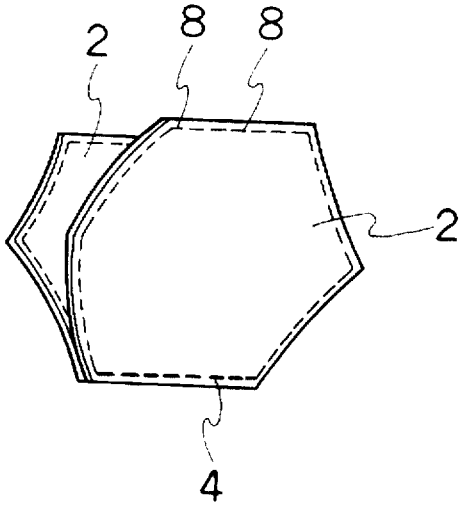
FIG. 3 is a perspective view illustrating a process of sewing work.
Figure 4:
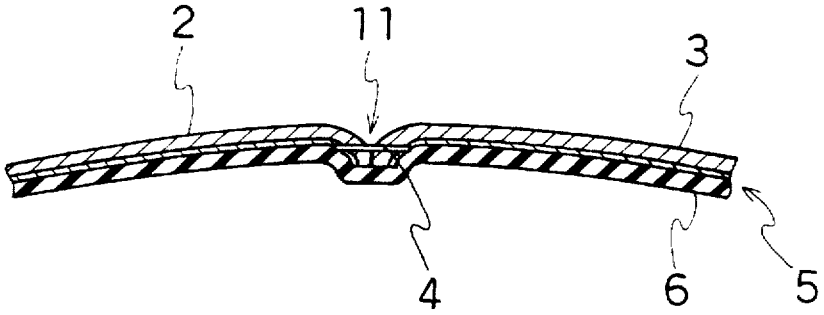
FIG. 4 is a cross sectioned view like FIG. 2 but illustrating a state of opening of a seam.

As shown in FIG. 1 to FIG. 3, a natural leather or artificial leather adhering to a reinforcing cloth layer 7 on its back side is cut, and twenty hexagonal panels 2, 2 . . . , and twelve pentagonal panels 3, 3 . . . are formed, and plural sewing holes 8, 8 . . . are opened in the periphery of the panels, and the panels 2, 2 . . . , 3, 3 . . . are sewn together by a self-shrink thread 9 to form a spherical leather skin layer 5, and a rubber bladder 6 is put therein to prepare a size No. 5 soccer ball 1. The artificial leather is made of polyurethane resin, PVA resin or other resin, which is fashioned after a natural leather.

As the self-shrink thread 9, a high shrinkage polyester fiber which shrinks by heating can be used, for example, Soclatex (registered trademark of Teijin). Heat treatment is done by immersing the soccer ball 1 into 100° C. boiling water, or putting the ball into a heated die. The thread 9 instantly shrinks by 50% when immersed in boiling water without applying tension to the thread (no-load state). At the same time, this thread 9 has a high shrink stress, and, for example, when the shrink thread of the total denier number of 12,000 is put in boiling water to shrink 10%, the tightening force is raised by about 1 kg, and this tightening force is maintained if the temperature is lowered to ordinary temperature. After shrinking, a high strength holding rate is provided.

Figure 5:
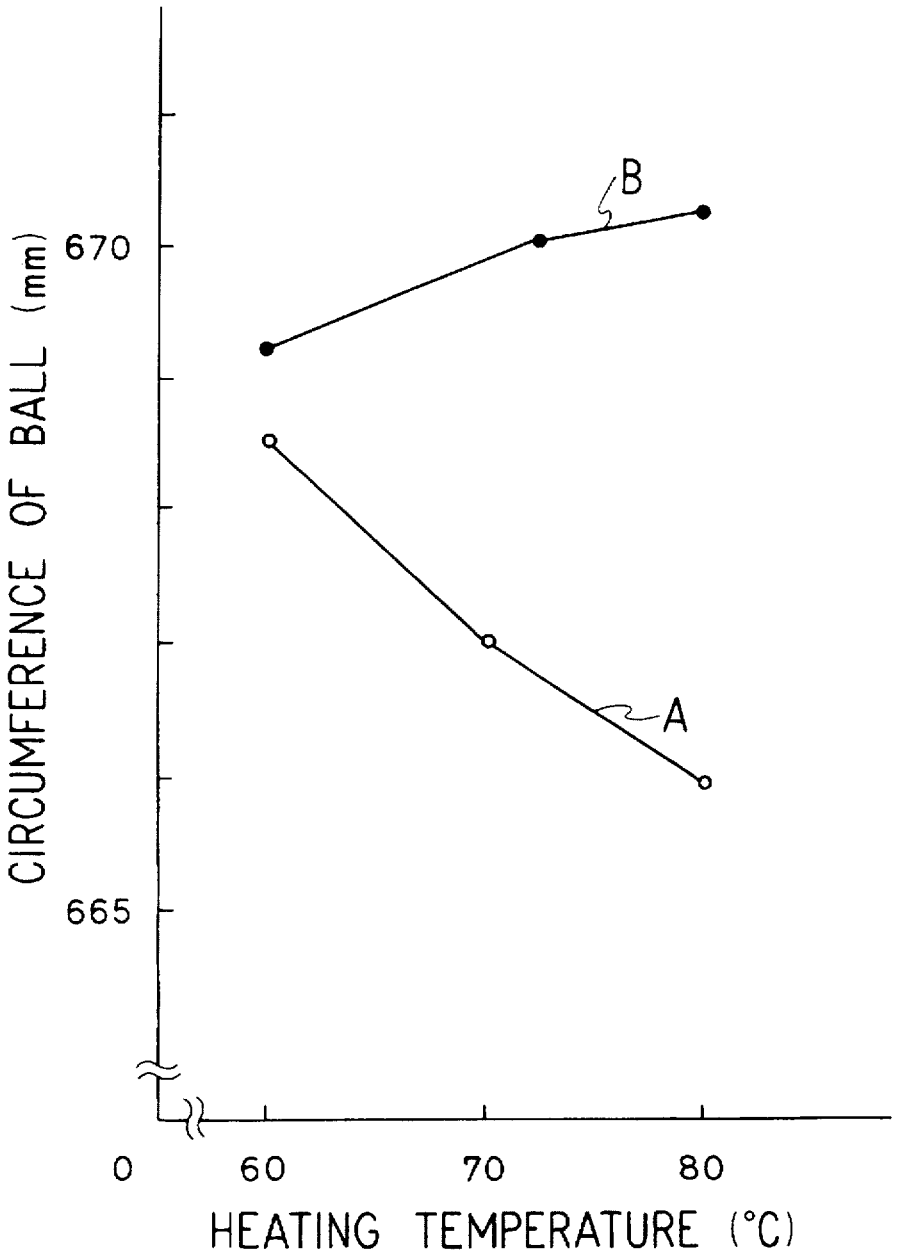
FIG. 5 is a curve showing a circumference-heating temperature characteristic.

FIG. 5 shows the result of measurement of the ball circumference (ball girth) after heat treatment at different heating temperatures by fabricating the soccer ball 1 by using a self-shrink thread 9 of 12,000 denier count. As indicated by curve A, at 60° C., the circumference was hardly changed, and at 80° C., the circumference decreased by about 2.6 mm or about 0.4% as compared with that at 60° C. By way of comparison, the circumference of the ball fabricated by using a conventional non-shrink thread (11,500 denier) is indicated by curve B. This conventional ball is free from effects of temperature, and theoretically the curve should be a horizontal line, but actually it was swollen a little (about 0.15%). By using the self-shrink thread 9, it is hence known that the seam is tightened firmly and the circumference of the ball is slightly smaller.

The self-shrink thread 9 shrinks by heating, and firmly tightens the sewn portions of the leather panels 2, 3. By this tightening, partial loosening in sewing, or individual difference in sewing strength by sewing operators is canceled, and a uniform and powerful tightening force is obtained. According to the experiment by the inventors, by measuring the circumference before and after shrinkage treatment in 100 soccer balls and calculating the standard deviation, it was 1.733 before treatment, and 0.966 after treatment. The standard deviation after treatment was about 55% of the value before treatment, which means that the fluctuation range of circumference is narrowed to about half.

Figure 6:
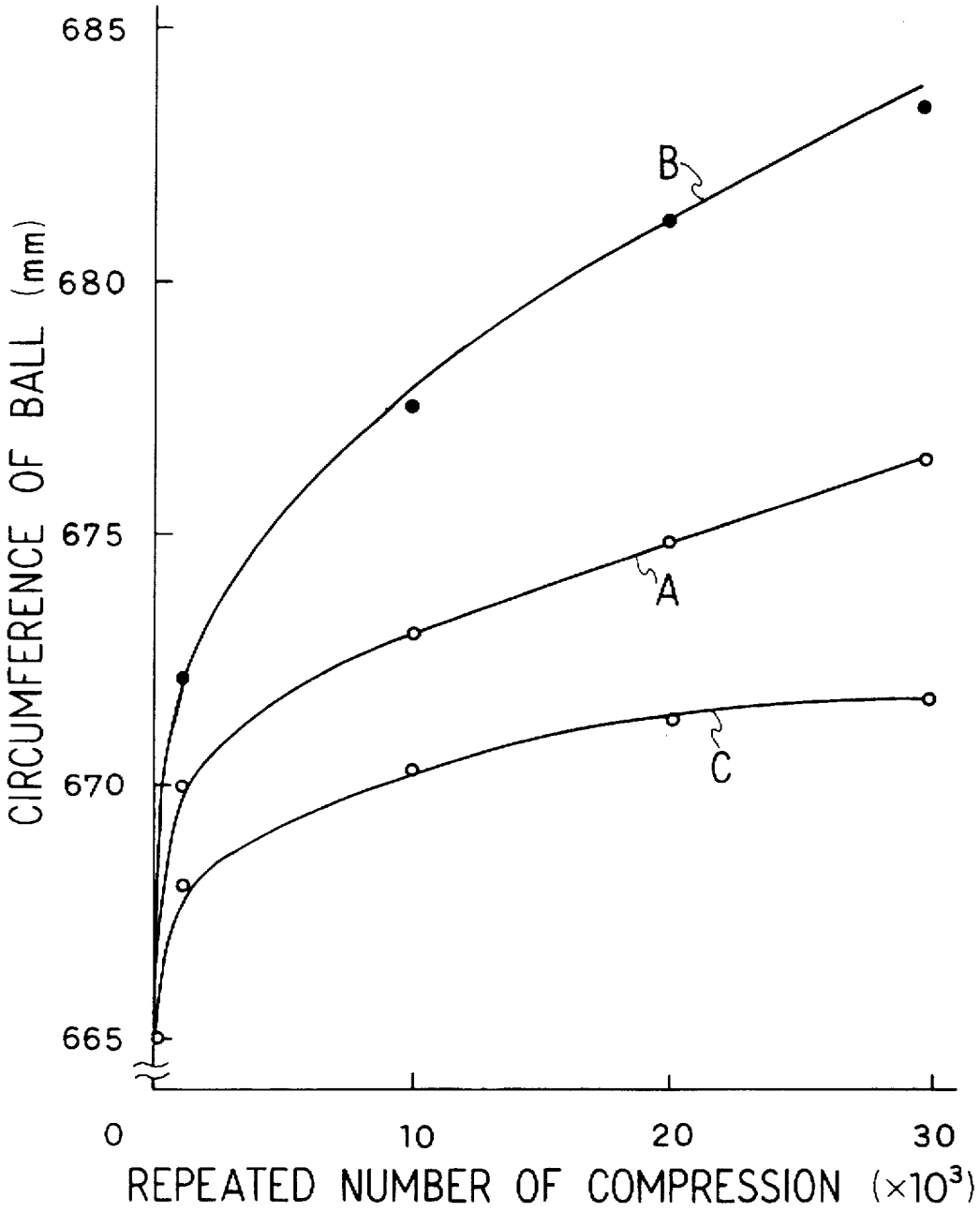
FIGS. 6 and 7 are each curves showing a circumference-number of compressing test characteristic of a soccer ball using a self-shrink thread which shrinks by heating and absorbing water, respectively.

FIG. 6 shows the result of a durability test of a soccer ball 1 sewn with self-shrink thread 9, by heating and shrinking for 10 minutes in a thermostatic oven at 80° C. The durability test was done by compressing the ball repeatedly to 33% of its diameter, and after 30,000 times of compression (corresponding to the use for about six months) as indicated by curve A, the circumference was increased from 665 mm to 676 mm, and the increment rate was 1.7%. At this time, an opening of a seam was not observed, and there was no problem in use. On the other hand, curve B indicates the similar compression test result of the ball sewn by conventional non-shrink thread, in which the circumference was increased from 665 mm to 684 mm (increment rate 2.9%). At this time, an opening of a seam was noted in the ball, and there was a problem in use of the ball in a game, e.g. it was not usable. Curve C shows the durability test result of a laminated ball, and the sewn ball of the invention (curve A) presented a durability similar to that of the laminated ball. For the ease of comparison with the ball of the embodiment, the conventional balls of curves B and C were identical in circumference with the ball of the embodiment.

The manufacturing method of the soccer ball of the embodiment is described. As shown in FIG. 3, as the leather panels, a natural leather or artificial leather with a reinforcing cloth layer 7 adhered to the back side is cut, and twenty hexagonal panels 2, 2 . . . , and twelve pentagonal panels 3, 3 . . . are prepared. Plural sewing holes 8 are formed in the periphery of each panel. These panels are hand-sewn by using the self-shrink thread 9, and a spherical leather skin layer 5 is formed.

A rubber bladder 6 is formed by heating and vulcanizing butyl rubber. Simultaneously when forming, a valve for feeding air into the bladder 6 is formed. This bladder 6 is put into the leather skin layer from an unsewn portion left at one side of the leather skin layer 5. A small circular hole 10 (FIG. 1) is formed in the center of one panel 2 of the leather skin layer 5, and the valve of the bladder 6 is positioned at this hole 10, and the peripheral area of the valve is adhered to the back side of the leather skin layer 5. The adhesion between the leather skin layer 5 and bladder 6 is in the valve peripheral area only, and in the other parts, the two are in a separate state. After putting in the bladder 6, the unsewn portion of the leather skin layer 5 is sewn together.

Thus sewn ball 1 is put into a die having a spherical cavity matching with the contour of the ball 1, and is heated for 10 minutes at 80° C. in a state packed with compressed air at specified pressure. As a result, the self-shrink thread 9 shrinks, and the leather panels 2, 3 are bound with a strong tightening force. The heat treatment may be done, aside from the method of using the heating die, for example, by putting the ball in the air for 30 minutes in a thermostatic oven controlled at 80° to 90° C., with the ball internal pressure kept at 0 to 0.3 kg/cm$^2$, and a similar shrinking action is obtained.

As the self-shrink thread 9 which shrinks by heating, aside from the high shrinkage polyester fiber, acrylic fiber, acetate fiber, vinylidene fiber, nylon fiber, polyvinyl chloride fiber, polyethylene fiber, and polypropylene fiber may be used by special treatment for drawing and crimping so as to have shrinking action.

In the embodiment, the self-shrink thread 9 refers to the thread which shrinks by heating, but, instead, it is also possible to use other self-shrink thread 9 which shrinks by absorbing water, and therefore the case of using water-absorption type self-shrink thread 9 is explained below. As such self-shrink thread 9, the wet shrink PVA fiber, high shrinkage vinylon known as Cremona (trademark of Kuraray) can be used.

The water-absorption type self-shrink thread 9 instantly shrinks by about 30% in water at ordinary temperature (20° C.). This shrinkage thread 9 also has a high shrink stress, and, for example, if water is absorbed in tensile state by applying a load of 300 g to water absorption shrinkage thread of 12,000 denier, it shrinks more than 10%. The high tightening force by shrinkage is maintained after drying.

TABLE 1

| | before absorbing water treatment | after absorbing water treatment | shrinking rate |
|---|---|---|---|
| ball of embodiments | 689 mm | 682 mm | 1.0% |
| conventional ball | 690 mm | 688 mm | 0.3% |

Table 1 shows the result of measurement of circumference by preparing a soccer ball by using self-shrink thread 9 with 12,000 denier, immersing in water, and drying. By way of comparison, the result of the soccer ball using the conventional non-shrink thread (11,500 denier) is also shown. As known from this table, the shrinkage rate of the soccer ball of the embodiment was 1.0%, which was higher than 0.3% shrinkage rate of the conventional soccer ball. Incidentally, the conventional soccer ball also shrank slightly, which was estimated to be shrinkage due to drying of the leather panels.

The self-shrink thread 9 shrinks by absorbing water, and tightens the sewn portions of the leather panels 2, 3 firmly. As a result, partial loosening in sewing, or individual difference in sewing strength by sewing operators is canceled, and a uniform and powerful tightening force is obtained. That is, the same effects as when using the heat shrinkage type self-shrink thread are obtained.

Figure 7:
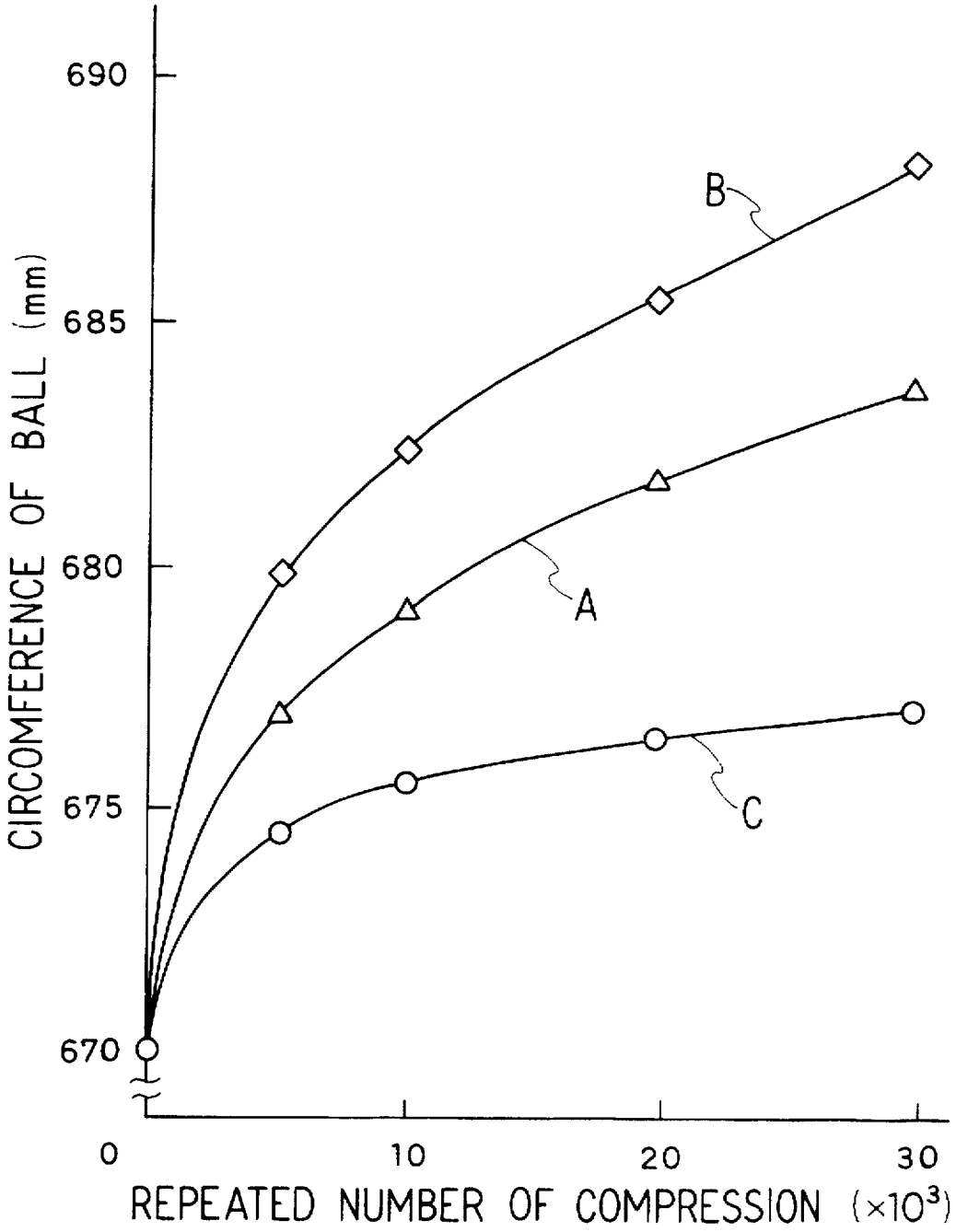

FIG. 7 shows the result of a durability test by preparing the soccer ball 1 by using water-absorption type self-shrink thread 9, and shrinking the self-shrink thread 9 by immersing in water and drying. The durability test conditions are same as in the previous test. As indicated by curve A, after 30,000 times of durability test, the circumference was increased from 670 mm to 683 mm, and the increment rate was 1.9%. At this time, an opening of a seam was not observed, and there was no problem in use. On the other hand, curve B indicates the result of the ball sewn by conventional non-shrink thread, in which the circumference was increased from 670 mm to 688 mm (increment rate 2.7%), and an opening of a seam was noted in the ball, and there was problem in game, and it was not usable. Curve C shows the test result of a laminated ball. The sewn ball of the embodiment (curve A) presented a durability similar to that of the laminated ball. For the ease of comparison with the ball of the embodiment, the conventional balls of curves B and C were identical in circumference with the ball of the embodiment.

The soccer ball 1, in its final process of manufacture, is immersed in water by force to shrink the self-shrink thread 9, and the binding force of the mutual leather panels is reinforced. However, in another method, the soccer ball may be sold to customers without water absorption treatment, and when it is soaked in rainwater or the like during use, the self-shrink thread 9 may be wet to shrink naturally.

Figure 8:
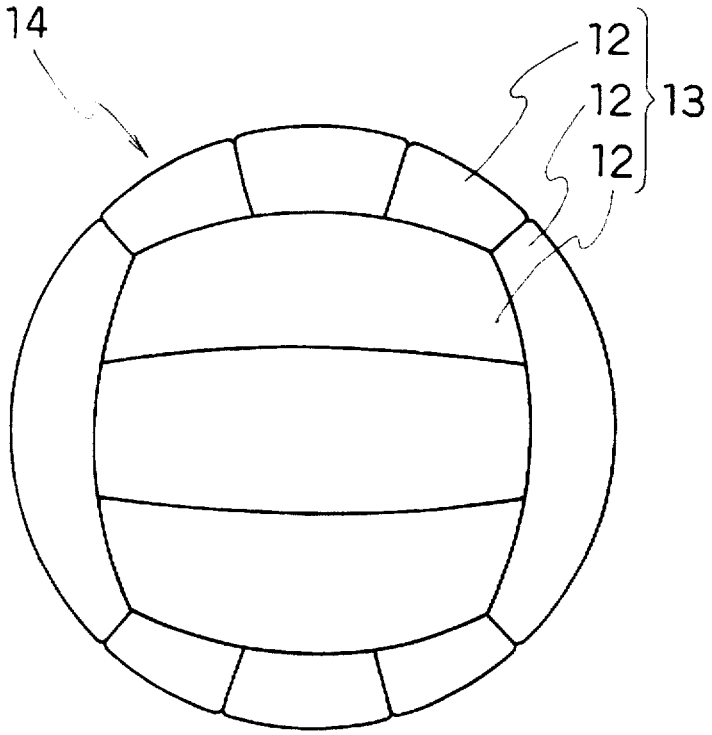
FIG. 8 is a front view illustrating beach volley ball of the present invention.

In the foregoing embodiments, twenty hexagonal leather panels and twelve pentagonal leather panels are sewn together to form a soccer ball, but the invention may be also applied in the soccer ball prepared by sewing thirty hexagonal leather panels and twelve pentagonal leather panels. It is also applied to the handball having the leather skin layer in the same pattern as the soccer ball. It is also effective to apply in the volleyball, especially beach volleyball and playground ball forming the leather skin layer by sewing twelve or eighteen nearly square panels. FIG. 8 shows a beach volleyball 14 having a leather skin layer 13 sewn by using eighteen slender quadrangular leather panels 12, 12 . . . , laying three panels parallel to form a set, preparing six sets thereof, and arranging into a spherical form so that the array direction of each set may cross orthogonally.

According to the invention, using a self-shrink thread which shrinks by heating or absorbing water as the sewing thread of a ball for a ball game having sewn structure, by shrinking after sewing a ball, the leather panels are bound with a uniform strong tightening force. Accordingly, if used repeatedly, the seam is not opened, and the game performances such as gripping, ball control, and stability of trajectory by kicking or hitting are maintained in a high state, while the touch is soft and pain is less when hitting against part of the body. Moreover, increase of circumference is suppressed, and a stable shape is retained for a long period, and hence, while preventing the swelling tendency which was a defect of a conventional sewn ball, the durability is enhanced notably.

In the invention, if there is individual difference among the sewing operators in the sewing strength of the thread before shrinking, the self-shrink thread shrinks by heating or absorbing water of the leather skin layer after sewing the leather panels, and the difference is canceled, and a uniform and high tightening force is obtained, and a stable durability is realized.

Also according to the invention, by using high shrinkage polyester fiber or wet shrink PVA fiber as the self-shrink thread, a uniform and advanced shrinkage rate is obtained, and the mechanical strength is sufficient, and therefore it is optimum for the ball for a ball game in severe conditions where the ball is exposed to a destructive external force.

Further according to the invention, since the seam is hardly opened after sewing, the grooves formed in the seams are kept for a long period. Hence, the gripping and ball control performance obtained by the seams will not be lost, and it is particularly useful when applied in a soccer ball, handball, volleyball, and playground ball that require such properties.

Though several embodiments of the present invention are described above, it is to be understood that the present invention is not limited only to the above-mentioned embodiments, various changes and modifications may be made in the invention without departing from the spirit and scope thereof.

What is claimed is:

1. A ball for ball game comprising:

a leather skin layer formed by sewing a plurality of leather panels by a thread, said leather skin layer having a spherical shape; and a bladder made of an elastomer having a hollow spherical shape, said bladder being accommodated in said leather skin layer, said bladder being provided with a valve for feeding air into said rubber bladder, said bladder being charged with air through said valve;

wherein said thread is made of a self-shrink thread which is subjected to a shrinking treatment after sewing such that after shrinking, a high strength holding rate is provided binding said sewn leather panels of the leather skin layer of said ball to one another.

2. The ball for ball game of claim 1, wherein said self-shrink thread shrinks by heating.

3. The ball for ball game of claim 2, wherein said self-shrink thread comprises a high shrinkage polyester fiber.

4. The ball for ball game of claim 1, wherein said self-shrink thread shrinks by absorbing water.

5. The ball for ball game of claim 4, wherein said self-shrinking thread which shrinks by absorbing water comprises wet shrink polyvinyl alcohol fiber.

6. The ball for ball game of claim 3, wherein said leather skin layer comprises a plurality of hexagonal leather panels and pentagonal leather panels, and said ball for ball game can be used as soccer ball or handball.

7. The ball for ball game of claim 5, wherein said leather skin layer comprises a plurality of hexagonal leather panels and pentagonal leather panels, and said ball for ball game can be used as soccer ball or handball.

8. The ball for ball game of claim 3, wherein said leather skin layer comprises a plurality of substatially square leather panels, and said ball for ball game can be used as volleyball or playground ball.

9. The ball for ball game of claim 5, wherein said leather skin layer comprises a plurality of substantially square leather panels, and said ball for ball game can be used as volleyball or playground ball.

10. The ball for ball game of claim 1, wherein said shrinking treatment after sewing shrinks said thread an amount sufficient to uniformly and firmly tighten the sewn leather panels to each other with a tightening force which is greater than that with a sewn ball fabricated using a conventional non-shrink thread.

11. The ball for ball game of claim 10, wherein said shrinking treatment after sewing shrinks said thread an amount sufficient to reduce the circumference of the ball.

12. The ball for ball game of claim 1, wherein said sewing of said leather panels includes hand sewing said leather panels by said self-shrink thread.

13. A ball for ball game comprising:

a leather skin layer formed by sewing a plurality of leather panels by a thread, said leather skin layer having a spherical shape; and a bladder made of an elastomer having a hollow spherical shape, said bladder being accommodated in said leather skin layer, said bladder being provided with a valve for feeding air into said rubber bladder, said bladder being charged with air through said valve;

wherein said thread is made of a self-shrink thread which shrinks by heating and which is subjected to a shrinking treatment after sewing such that after shrinking, a high strength holding rate is provided binding said sewn leather panels of the leather skin of said ball to one another with a tightening force which is greater than that with a sewn ball fabricated using a conventional non-shrink thread.

14. A ball for ball game comprising:

a leather skin layer formed by sewing a plurality of leather panels by a thread, said leather skin layer having a spherical shape; and a bladder made of an elastomer having a hollow spherical shape, said bladder being accommodated in said leather skin layer, said bladder being provided with a valve for feeding air into said rubber bladder, said bladder being charged with air through said valve;

wherein said thread is made of a self-shrink thread which shrinks by absorbing water and which is subjected to a shrinking treatment after sewing such that after shrinking, a high strength holding rate is provided binding said sewn leather panels of the leather skins of said ball to one another with a uniform and powerful tightening force.

* * * * *